United States Patent [19]

Hosoya et al.

[11] Patent Number: 4,656,965

[45] Date of Patent: Apr. 14, 1987

[54] DEVELOPING APPARATUS

[75] Inventors: Masahiro Hosoya, Yokohama; Tsutomu Uehara, Yokosuka; Shinya Tomura, Yamato, all of Japan

[73] Assignee: Kabushiki Kaisha Toshiba, Kawasaki, Japan

[21] Appl. No.: 844,613

[22] Filed: Mar. 27, 1986

Related U.S. Application Data

[63] Continuation-in-part of Ser. No. 831,092, Feb. 21, 1986, and a continuation of Ser. No. 785,038, Oct. 8, 1985, abandoned, which is a continuation-in-part of Ser. No. 655,444, Sep. 28, 1984, abandoned.

[30] Foreign Application Priority Data

Sep. 30, 1983 [JP] Japan ..... 58-182689
Sep. 30, 1983 [JP] Japan ..... 58-182743

[51] Int. Cl.[4] ..... G03G 15/06

[52] U.S. Cl. ..... 118/649; 118/651

[58] Field of Search ..... 118/649, 651

*Primary Examiner*—Bernard D. Pianalto
*Attorney, Agent, or Firm*—Oblon, Fisher, Spivak, McClelland & Maier

[57] ABSTRACT

A developing apparatus comprises a developing roll for carrying a nonmagentic toner thereon, and an elastic blade pressed against the outer circumferential surface of the developing roll to apply the toner thereto. The toner is applied to the surface of the developing roll by the elastic blade to form a thin layer of the toner on the surface of the developing roll. The thin layer is opposed to a photosensitive body to deposit the toner on a latent image on the photosensitive body. The developing roll has a surface which is opposite to the photosensitive body and the whole of which is roughened.

13 Claims, 22 Drawing Figures

DEVELOPING APPARATUS

CROSS-REFERENCE TO RELATED APPLICATIONS

This application is a continuation-in-part of application Ser. No. 831,092, filed Feb. 21, 1986. That application was a continuation of application Ser. No. 785,038, filed Oct. 8, 1985, abandoned. That application in turn was a continuation-in-part of application Ser. No. 655,444, filed Sept. 28, 1984, abandoned.

FIELD OF THE INVENTION

The present invention relates to a developing apparatus and, more particularly, to an improvement in a developing apparatus in which a latent image formed on a photosensitive body or a dielectric body is visualized by using a one-component developing agent consisting of only nonmagnetic toner in an electrophotography apparatus or an electrostatic recording apparatus.

BACKGROUND OF THE INVENTION

Such developing apparatuses can be classified into apparatuses which use a two-component developing agent consisting of toner and a carrier and apparatuses which use a one-component developing agent consisting only of magnetic toner. With recent technical advances in this field, a developing apparatus which uses a one-component developing agent consisting only of nonmagnetic toner which can resolve defects of the one-component developing agent consisting only of magnetic toner has been developed. However, such a developing apparatus has a big problem in that it is difficult to stably form a uniform thin toner layer on a surface of a movable developing agent carrier, thereby preventing the practical use of this apparatus.

In this manner, the present inventors have invented a developing apparatus shown in FIG. 1 (Japanese Patent Application No. 57-155934), and they have succeeded in forming a thin layer of nonmagnetic toner. In this invention, as shown in FIGS. 1 and 2, a rubber blade 2 as a flexible coating member is brought into surface contact with a developing roll 1 as a movable developing agent carrier except for a free end portion of the rubber blade—i.e., an edge portion positioned at a downstream side along the flow of the developing agent. Nonmagnetic toner 4 is fed from, for example, a toner holder 3 to a surface of the developing roll 1. The toner 4 is uniformly coated by the rubber blade 2 on the surface of the developing roll 1, thereby forming a thin toner layer. This thin layer is opposed to a photosensitive drum 5 as a latent image carrier, thereby developing a latent image thereon.

According to the developing apparatus described above, the contact area between the surface of the movable developing agent carrier and the flexible coating member can be set to be large. In addition, no edge portion of the flexible coating member is brought into contact with the surface of the developing agent carrier, thereby preventing a pressing force from acting on the surface thereof. As a result, nonuniformity caused by variations in setting conditions, mechanical precision, wear or the like can be moderated, thereby forming a satisfactorily uniform toner layer. Moreover, since the contact area between the surface of the carrier and the coating member is large, the developing agent is subjected to friction for a sufficiently long period of time under the pressing force when it passes through this contact portion. As a result, the developing agent can be uniformly and sufficiently charged by friction. Therefore, since the developing agent having a sufficient electric charge can be formed into a uniform thin layer, a latent image can be satisfactorily developed.

However, the present inventors found by experiment that the above-mentioned developing apparatus has the following problems.

(1) In order to form a uniform thin toner layer, the pressing force on the rubber blade must be set to be larger than a predetermined value. Therefore, the toner layer formed on the surface of the developing roll becomes extremely thin. Microscopically, toner particles or toner aggregate is sparsely applied on the surface of the developing roll. As a result, when the toner layer is arranged to oppose a latent image carrier and then non-contact development is performed to form a developed image, the thus developed image cannot have a sufficient copy density.

(2) The nonmagnetic toner used in this apparatus must have a considerable flowability. When toner having a poor flowability is used, a toner path under pressure of the rubber blade is clogged by the toner aggregate, and the toner cannot pass this portion. For this reason, stripes are undesirably formed in the toner layer on the surface of the developing roll.

(3) When a foreign material is mixed in the developing agent particles, the foreign material clogs the toner path under pressure of the rubber blade, and the toner cannot pass this clogged portion. For this reason, stripes are undesirably formed in the toner layer on the surface of the developing roll.

The above problems (2) and (3) are mainly caused by undesirable slippage between the toner or the toner layer and the surface of the developing roll under the pressing force of the flexible coating member. This will be described with reference to FIG. 3. The toner 4 or a toner aggregate 6 is brought under the influence of the pressing force of the rubber blade 2 upon rotation of the developing roll 1 and is subjected to a blocking force F1 of the blade 2 and a feeding force F2 of the developing roll 1. Formation performance of the toner layer is determined by the shear property of the toner aggregate 6 under the forces F1 and F2. When the maximum static friction coefficient between the toner 4 and the developing roll 1 is small, the toner aggregate 6 begins to slip on the surface of the developing roll 1 before it is sheared, and it collects under the rubber blade 2. The passage of further toner particles is prevented by the collected toner aggregate. As a result, stripes having no toner particles are formed on the surface of the developing roll 1. It should be noted that, even if the part designated by the reference numeral 6 in FIG. 3 is not the toner aggregate but is a foreign material, stripes are formed in the toner layer in the same process.

The problem (1) is caused by the following behavior of the toner particles. In the toner particles collected due to the slippage, the toner particles which are in contact with the surface of the developing roll gradually increase their frictional charge, and an electrostatic attracting force with respect to the developing roll is also increased. When the attracting force is increased, the dynamic frictional force between the toner particles and the developing roll is also increased. When the frictional force reaches a predetermined value, the toner aggregate is sheared. The thus sheared toner is fed by the developing roll. In this manner, since the toner aggregate is intermittently sheared, the toner layer having a low copy density is sparsely formed on the surface of the developing roll, resulting in a low copy density of the developed image.

OBJECT OF THE INVENTION

It is an object of the present invention to provide a developing apparatus in which a high quality image which is uniform and has sufficient copy density can be stably formed by using a one-component developing agent consisting of nonmagnetic toner.

SUMMARY OF THE INVENTION

In order to attain the above object, there is provided a developing apparatus which comprises a developing agent carrier for carrying a developing agent thereon. An elastic member is pressed against the surface of the developing agent carrier to apply the developing agent thereto. The developing agent is applied to the surface of the developing agent carrier by the elastic member to form a thin layer of the developing agent on the surface of the developing agent carrier, and the thin layer is opposed to an image carrier to deposit the developing agent on a latent image on the image carrier. The surface of the developing agent carrier which is opposite to the image carrier is roughened, and the relationship among $\mu t$, $\mu b$, and $\mu r$ is:

$$\mu t < \mu b < \mu r$$

where the value $\mu r$ is the friction coefficient between the developing agent carrier and the non-magnetic developing agent, the value $\mu t$ is the friction coefficient between the particles of the developing agent, and the value $\mu b$ is the friction coefficient between the elastic member and the non-magnetic developing agent.

DETAILED DESCRIPTION OF THE PREFERRED EMBODIMENTS

Figure 5:
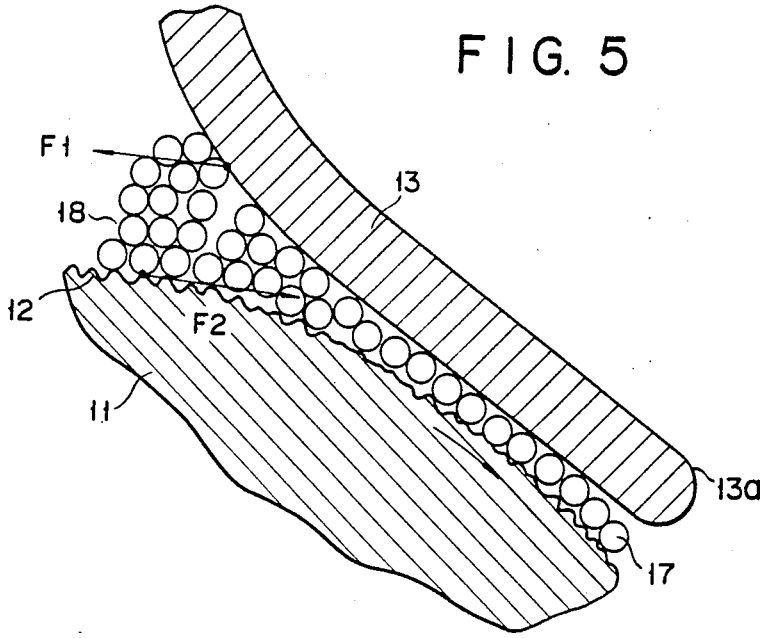
FIG. 5 is an enlarged sectional view showing the contact area between the developing roll and the elastic blade in the apparatus of FIG. 4.
Figure 6:
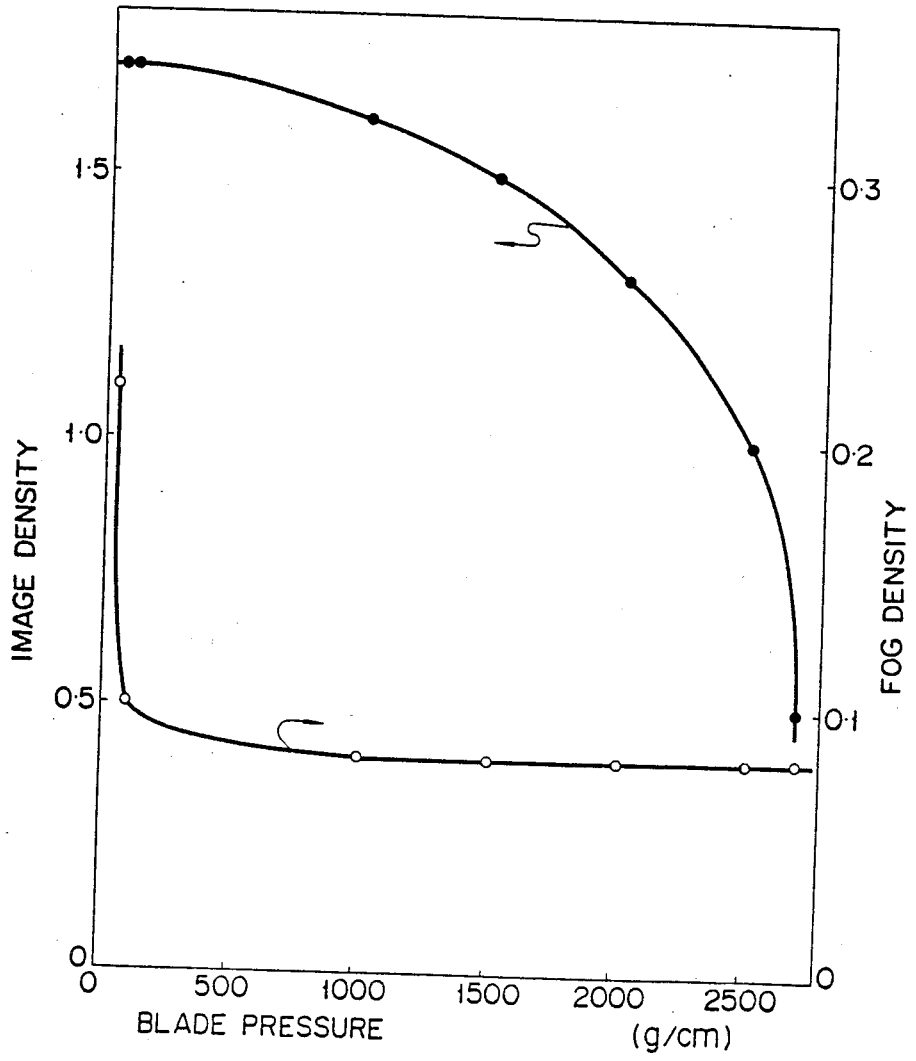
FIG. 6 is a chart showing the relationship of blade-pressure to copy density and to fog density.

One embodiment of a developing apparatus according to the present invention will be described with reference to FIGS. 4 to 6 in detail hereinafter.

Figure 1:
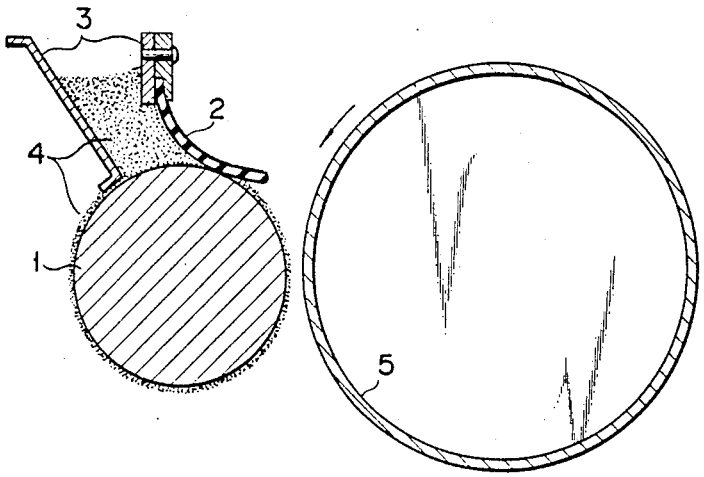
FIG. 1 PRIOR ART
FIGS. 1 and 2 are a sectional view and a perspective view, respectively, showing a prior art developing apparatus.
Figure 2:
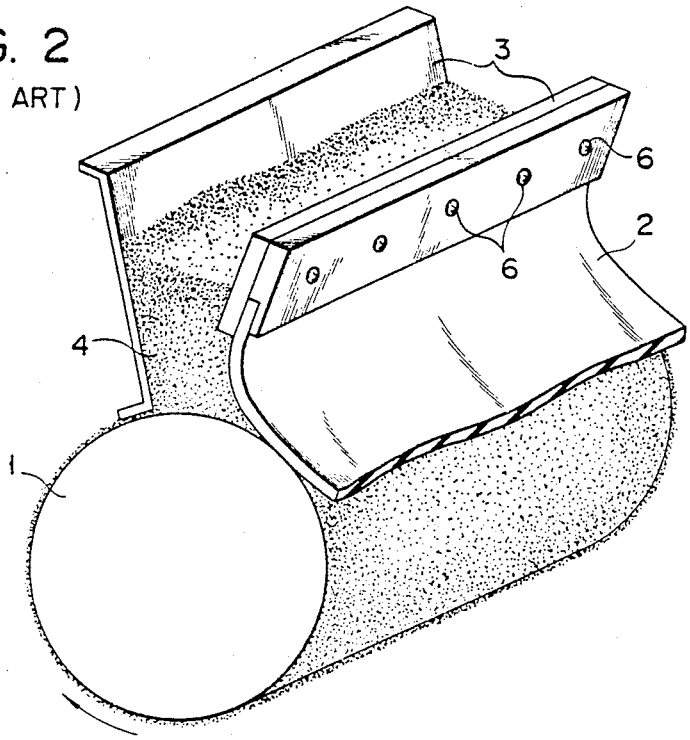
FIG. 2 (PRIOR ART)
Figure 3:
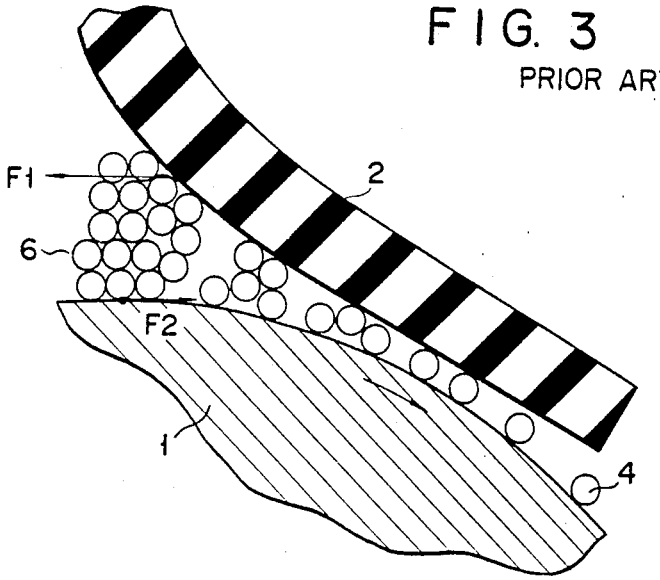
FIG. 3 PRIOR ART
FIG. 3 is an enlarged sectional view showing the contact area between the developing roll and the elastic blade in the prior art.
Figure 4:
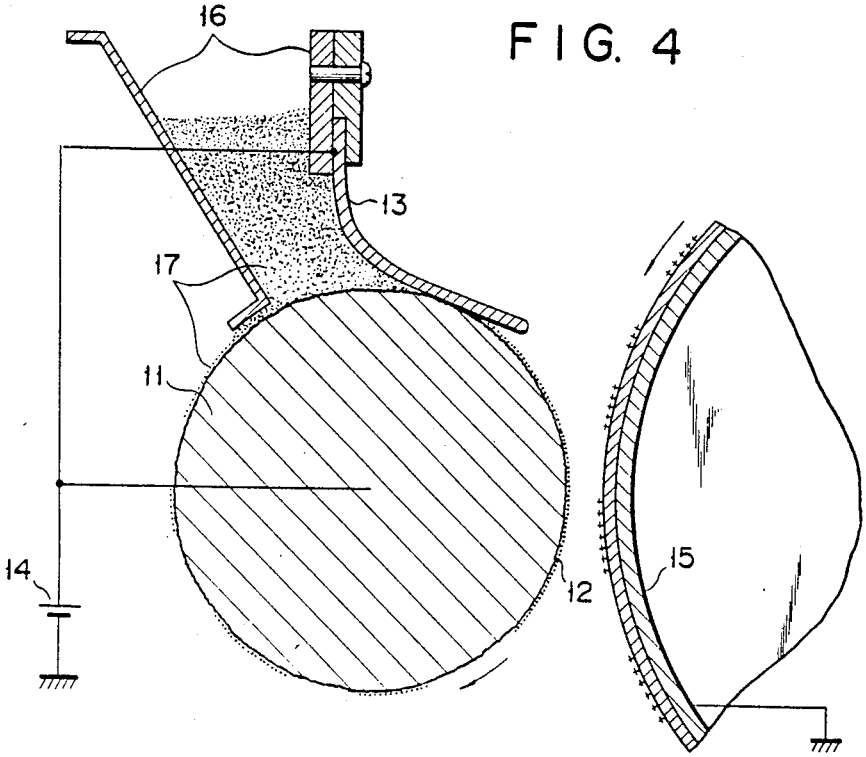
FIG. 4 is a sectional view showing a developing apparatus according to one embodiment of the present invention.

In FIG. 4, reference numeral 11 denotes a developing roll as a movable developing agent carrier which is supported to be rotatable clockwise. A roughened surface 12 is uniformly formed on a surface (the outer circumferential surface) of the developing roll 11 by a sandblast treatment.

Reference numeral 13 denotes a metal plate having elasticity as a flexible coating member. An outer curved surface of the metal plate 13 is urged against the outer circumferential surface of the developing roll 11 to be brought into surface contact therewith. In other words, the free end portion of the metal plate 13 (i.e., an edge portion thereof positioned at the downstream side with respect to the flow of the toner) is not brought into contact with the developing roll 11. Therefore, the surface of the metal plate 13 except for the free end portion is brought into surface contact with the outer circumferential surface of the developing roll 11. In order to obtain a uniform frictional charge and a thin toner layer of a suitable thicknes, a pressing force with respect to the developing roll 11 is preferably set to fall within the range between 100 g/cm and 2,500 g/cm. Note that the pressing force here means a pressure per centimeter measured along a direction parallel to a central shaft of the developing roll 11. If the pressing force is set to be less than 100 g/cm, the toner aggregate passes under the pressing force such that it is not sheared into a sufficiently thin layer due to the small blocking force (i.e., the pressure for blocking passage of the toner under the pressing force) by the metal plate 13. For this reason, the thickness of the thin layer formed on the surface of the developing roll 11 is increased. As a result, although the copy density is also increased, noncharged toner particles which are not subjected to frictional charge are also increased, thereby causing a fog. On the other hand, when the pressing force exceeds 2,500 g/cm, the thin toner layer becomes extremely thin, and a sufficient copy density cannot be obtained.

The metal plate 13 is preferably made from phosphor bronze, but a stainless steel plate can be used instead of the phosphor bronze plate. When the phosphor bronze plate is selected among these coating member materials, the thickness thereof is preferably set to be 0.1 to 0.4 mm in order to form a thin toner layer having a proper thickness. If the thickness of the metal plate 13 is less than 0.1 mm, its bending modulus becomes small. Then, it is difficult to form a thin toner layer having a proper thickness. On the other hand, if the thickness of the metal plate 13 exceeds 0.4 mm, the nip width between the developing roll 11 and the metal plate 13 is decreased, thereby increasing the pressing force acting per unit area. The toner particles are immediately subjected to a high pressure under the pressing force. Therefore, the toner particles are attached and fused to the surface of the developing roll 11 due to frictional heat. The fused particles result in a nonuniform thin toner layer. Note that at least an end face of the metal plate 13 positioned adjacent to the surface of the developing roll 11 is preferably formed into a curved surface 13*a* with a view to easy assembly.

Furthermore, reference numeral 14 denotes a power source for applying a bias voltage both to the developing roll 11 and to the metal plate 13. Reference numeral 15 denotes a selenium photosensitive drum as a latent image carrier which is opposed at a predetermined distance (for example, 250 μm) to the developing roll 11 and is rotated counterclockwise. In addition, reference numeral 16 denote a toner holder which is provided above the developing roll 11 and feeds nonmagnetic toner 17 to the outer circumferential surface of the developing roll 11.

According to such a construction as described above, when the developing roll 11 is rotated clockwise, the nonmagnetic toner 17 held in the toner holder 16 is fed along the outer circumferential surface of the developing roll 11 under the pressing force of the metal plate 13 having elasticity as the flexible coating member. In this case, the metal plate 13 has a large modulus of elasticity in comparison to that of a rubber plate, and it has a small deformation amount with respect to the pressure caused by fixing jigs and the like. In addition, the metal plate 13 has a small plastic deformation amount, and a curved outer portion thereof is in contact with the outer circumferential surface of the developing roll 11. For this reason, the pressing force of the metal plate 13 acting on the developing roll 11 becomes uniform, thereby forming a thin toner layer having a uniform thickness. Furthermore, by constructing the flexible coating member using a metal plate, when the toner 17 is pressed by the metal plate 13, the surface of the metal plate 13 cannot be charged up by continuous friction with the toner 17. Therefore, since the toner charge and the shear force acting on the toner aggregate always become constant, a thin toner layer having a constant charge and a uniform thickness can be stably formed.

Since the roughened surface 12 is formed on the surface of the developing roll 11, friction between the toner 17 and the developing roll 11 is increased. Then, a toner aggregate 18 can be sheared without slippage with respect to the surface of the developing roll 11, as shown in FIG. 5, thereby forming a thin toner layer in which the toner particles 17 are densely aligned on the surface of the developing roll 11. In other words, the thin toner layer is formed by repeatedly shearing the toner aggregate 18 under a blocking force F1 of the metal plate 13 and a feeding force F2 of the developing roll 11. When the smoothness of the surface of the developing roll 11 is high, the slippage occurs between the toner aggregate 18 and the surface of the developing roll 11, and the toner aggregate 18 is gathered under the pressing force of the metal plate 13. As a result, further toner particles cannot pass this position, thereby forming stripes in the thin toner layer. When a toner having a strong self aggregation property is used, such tendency is considerable. Therefore, since the roughened surface 12 is formed on the surface of the developing roll 11, the slippage between the toner aggregate 18 and the developing roll 11 can be prevented, thereby forming a uniform thin toner layer regardless of the self aggregation of the toner.

In order to prevent a fog, when the thin toner layer is formed, the power source 14 supplies a bias voltage to the metal plate as well as the developing roll 11, thereby short-circuiting them. Therefore, the surface of the metal plate 13 cannot be charged by friction.

The photosensitive drum 15 is arranged to oppose the developing roll 11 having the thin toner layer thereon. When the thin toner layer on the roll 11 is adjacent to a latent image formed on the drum 15 upon rotation of the drum 15, the negatively charged toner particles 17 are applied to the latent image through a gap, thereby forming a developed image.

Since a metal plate is used as the flexible coating member and is arranged to be brought into surface contact with the developing roll 11 except for the end face thereof, a thin toner layer having a uniform thicknes can be stably formed and a high quality developed image having a constant copy density can be obtained with high reproducibility. Particularly, since a phosphor bronze plate having a large elastic limit is used as the metal plate, a constant pressing force can be obtained, and plastic deformation can be prevented, thereby obtaining a developed image having a constant copy density. Furthermore, since the roughened surface 12 is formed on the surface of the developing roll 11, toner density on the surface of the developing roll 11 can be increased, thereby obtaining a developed image having a high copy density.

When the toner aggregate is under the pressing force of the metal plate 13, the toner aggregate is destroyed by the large frictional force between the roughened surface 12 of the developing roll 11 and the metal plate 13. For this reason, no toner particle is clogged under the pressure force of the metal plate 13, thereby constantly forming a uniform thin toner layer. When a foreign material is inserted under the pressing force of the metal plate 13, the uniform thin toner layer can be formed by the same destroy and feeding effects as described above.

Furthermore, since the free end portion of the metal plate 13 is not in contact with the developing roll 11 and the surface thereof, the developing apparatus according to this embodiment can have a satisfactory effect that is the same as that of the prior art. Furthermore, since the surface of the metal plate 13 except for the free end portion is arranged to be in contact with the developing roll 11 having the roughened surface 12, the uniform thin toner layer can be stably formed without losing the thickness adjusting function of the thin toner layer by the metal plate 13.

In other words, if the free end portion of the metal plate 13 is arranged to be in contact with the developing roll 11 having the roughened surface 12, the free end portion thereof is considerably worn in comparison with the case wherein a developing roll having no roughened surface 12 is used. For this reason, the thickness adjusting function of the metal plate 13 can be easily changed. Therefore, when the roughened surface 12 is formed on the surface of the developing roll 11, and the surface of the metal plate 13 except for the free end portion is arranged to be in surface contact therewith, the roughened surface 12 of the developing roll 11 can be effectively used.

Furthermore, the relationship among $\mu t$, $\mu b$, and $\mu r$ is set to be:

$$\mu t < \mu b < \mu r$$

where the value $\mu r$ is the friction coefficient between the developing agent carrier and the non-magnetic developing agent, the value $\mu t$ is the friction coefficient between the particles of the developing agent, and the values $\mu b$ is the friction coefficient between the elastic member and the non-magnetic developing agent.

Still further, the developing apparatus of the present invention has a satisfactory effect in a non-contact developing method. The non-contact developing method has advantages in prevention of a fog and an application for overlapping color development. In the developing apparatus according to the present invention, the thin toner layer is formed on the surface of the developing roll, and it is applied to a latent image surface, thereby performing development. For this reasons, when the present invention is adopted in a contact type developing apparatus in which a thin toner layer is in contact with a latent image surface to perform development, in order to prevent damage to a photosensitive body due to contact with a developing roll, setting of the positions of the roll and the photosensitive body requires a high mechanical precision. Therefore, a gap between the developing roll and the photosensitive body must be more than a thickness of the thin toner layer. In other words, when the thickness of the thin toner is regulated to be less than the above-mentioned gap, many effects of preventing damage to the photosensitive body and formation of a fog, as well as an application in overlapping color development, can be obtained.

In a preferred embodiment, the developing roll 11 which is supported as the movable developing agent carrier so as to be rotatable clockwise is made of aluminum and has a diameter of 40 mm. The surface of the developing roll 11 has the roughened surface 12 having a JIS 10-point average roughness of 4 μm created by a sandblast treatment. The phosphor bronze plate 13 has a thickness of 0.2 mm. The outer surface of the phosphor bronze plate 13 except for its free end portion is urged against the outer circumferential surface of the developing roll 11. The selenium photosensitive drum 15 is used as the latent image carrier. Furthermore, particles of an average diameter of 14 μm which contain polystyrene, carbon, a charging control agent, and the like are used as the nonmagnetic toner particles 17 held in the toner holder 16.

In the developing apparatus having the abovementioned construction, when the developing roll 11 was rotated clockwise, a thin toner layer was formed on the surface of the developing roll 11. When the thus obtained thin toner layer was subjected to noncontact development with respect to the photosensitive drum 15 which is arranged to oppose the developing roll 11, the relationship between the pressing force of the phosphor bronze plate 13, the image density and the fog density shown in FIG. 6 was found. Note that a maximum value of the surface potential of the photosensitive drum 15 was 800 V, the voltage from the power source 14 was 100 V, the gap between the developing roll 11 and the photosensitive drum 15 was 250 μm, and the peripheral velocity of the developing roll 11 and the photosensitive drum 15 were both 100 mm/sec. Assume that criteria for a good/bad image are an image density of 1.0 or more and a fog density of 0.1 or less. As is apparent from FIG. 6, when the pressing force of the phosphor bronze plate 13 falls in the range between 100 g/cm and 2,500 g/cm, a satisfactorily good image can be obtained.

When the developing operations were performed using phosphor bronze plates having a thickness of 0.05 mm, 0.1 mm, 0.4 mm, and 0.5 mm, respectively, the phosphor bronze plate of a thickness of 0.05 mm had a fog density of 0.2, the phosphor bronze plate of a thickness of 0.5 mm had an image density of 0.6, and the phosphor bronze plates of a thickness of 0.1 to 0.4 mm provided good images.

When the roughness of the roughened surface 12 of the surface of the developing roll is 0.07 to 1.5 times the average diameter of the toner particle, the effect of the roughened surface 12 becomes considerable. When the roughness is 0.07 or less times the average diameter of the toner particle, the friction between the toner and the surface of the developing roll 11 cannot become a satisfactory value, and it is difficult to form a uniform thin toner layer. On the other hand, when the roughness of the roughened surface 12 exceeds 1.5 times the average diameter of the toner particles, a good thin toner layer can be formed, but the following problems also occur. First, the differences between the thickness of the thin toner layer formed on the projecting portions of the surface and that formed on the recessed portions thereof becomes extremely large, resulting in a low resolution of the obtained image. Second, it is difficult to transfer toner particles inserted in the recessed portions to a latent image, and such toner particles collect in the recessed portions. For this reason, the surface of the developing roll 11 is covered with the collected toner particles, and further toner particles cannot be brought into contact with the surface of the developing roll 11. As a result, the number of noncharged toner particles which are not subjected to frictional charge is increased, resulting in a fog and a low image density.

Figure 7:
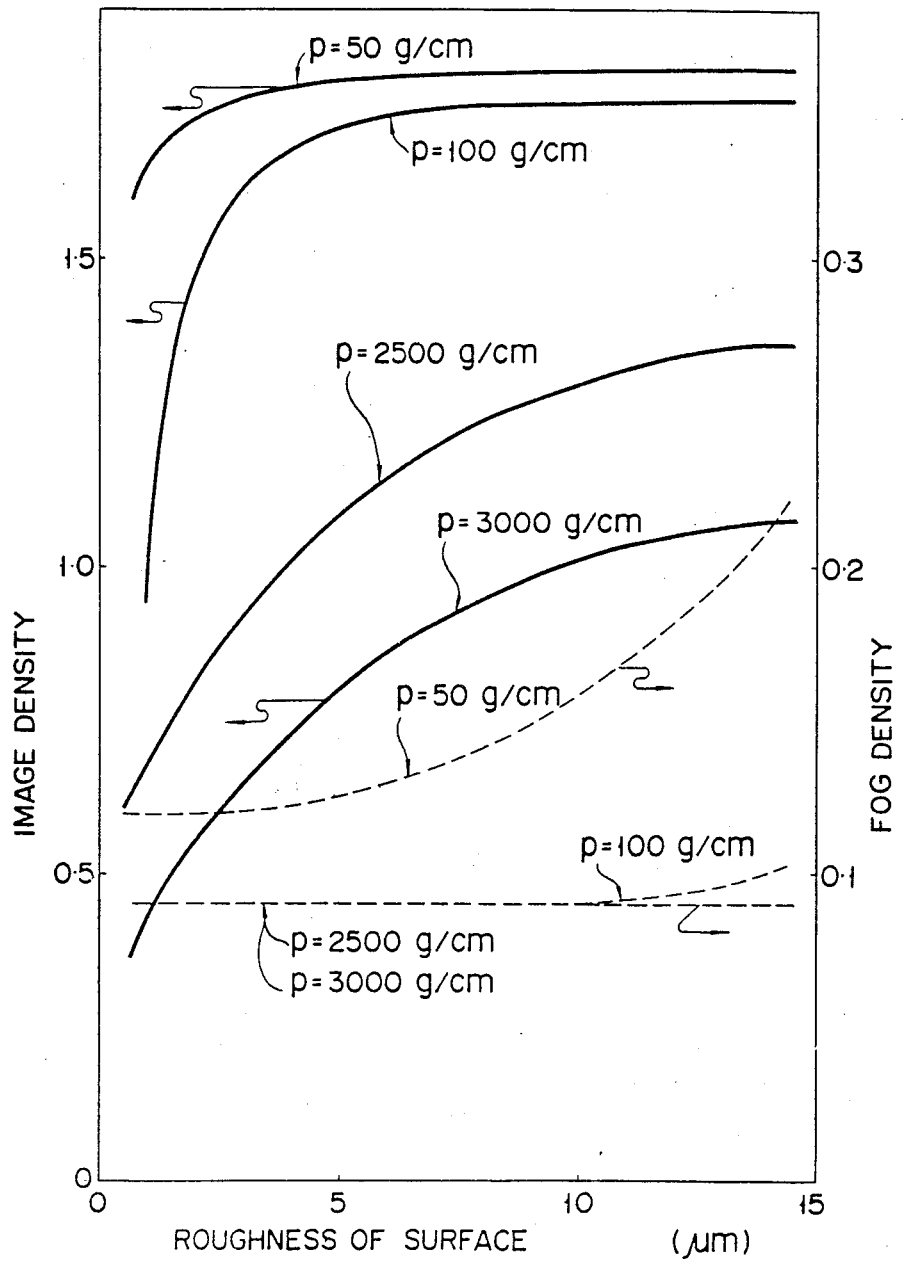
FIG. 7 is a chart showing the relationship of the roughness of the surface of the developing roll to the image density and the fog density in the apparatus of FIG. 4.

In the developing apparatus shown in FIG. 4, when the non-contact development was performed using developing rolls 11 respectively having roughened surfaces 12 of JIS 10-point average surface roughness (JIS-B0601) of 0.5 μm, 1 μm, 10 μm, 21 μm, and 28 μm, the relationship between the image density, the fog density, and the roughness of the roughened surfaces 12 of the developing rolls 11 shown in FIG. 7 was found.

Assume that the criteria of a good/bad image are an image density of 1.0 or more and a fog density of 1.0 or less. As is apparent from FIG. 7, a satisfactory image can be obtained when the roughness of the roughened surface 12 is 1 μm to 24 μm. Since the average diameter of the toner particle is 14 μm, the proper roughness of the roughened surface 12 falls within the range between 0.07 to 1.0 time the average diameter of the toner particle.

When the roughened surface 12 is formed on the surface of the developing roll 11 by sandblast treatment, it can be formed with high reproducibility. In the sandblast treatment, an abrasive is blown against the surface of the developing roll 11, thereby forming a roughened surface thereon. According to this treatment, the surface roughness can be controlled and good reproducibility can be provided, thus allowing mass-production. Since the shape of the roughened surface has no regularity, a developed image (coupled image) having a uniform quality can be obtained.

Furthermore, when a continuous copying operation was performed under the optimum conditions as described above, images having a satisfactory quality could be obtained after 5,000 copies, and no attachment of the toner particles on the surface of the developing roll 11 could be found.

The present invention is not limited to the construction of the above embodiment, and various changes and modifications may be made within the spirit and scope of the present invention.

For example, the roughened surface 12 of the developing roll 11 can be hard-plated. According to this hard plating treatment, mechanical wear of the surface of the developing roll 11 under the pressing force of the metal plate can be sufficiently reduced. It should be noted that the wear of the surface of the developing roll 11 allows changes in the surface roughness, resulting in changes in the thickness of the thin toner layer and changes in the copy density. This hard plating treatment allows prolonging of the life of the developing roll 11. For example, development was repeatedly performed using a developing roll 11 formed of aluminum having a surface roughness of 4 μm formed by the sandblast treatment, and another developing roll 11 whose surface was coated with a hard chromium plating layer having a thickness of 5 μm to have a final surface roughness of 4 μm after the sandblast treatment. The worn state of the projecting portions of the surfaces of the respective developing rolls was measured. After production of 5,000 copies, the surface roughness of the former developing roll was decreased from 4 μm to 2 μm, but that of the latter developing roll did not change at all. When the developing roll on which no hard chromium plating was performed was used, the copy density was also decreased in accordance with changes in the surface roughness. In the initial state, the copy density was 1.3. However, after production of 5,000 copies, the copy density was decreased to 1.1. When a developing roll on which the hard chromium plating was performed was used, no change in the copy density could be found. In this manner, when the hard chromum plating is performed on the surface of the developing roll, the stability of the development is increased, and the life of the developing roll is considerably increased.

Figure 8:
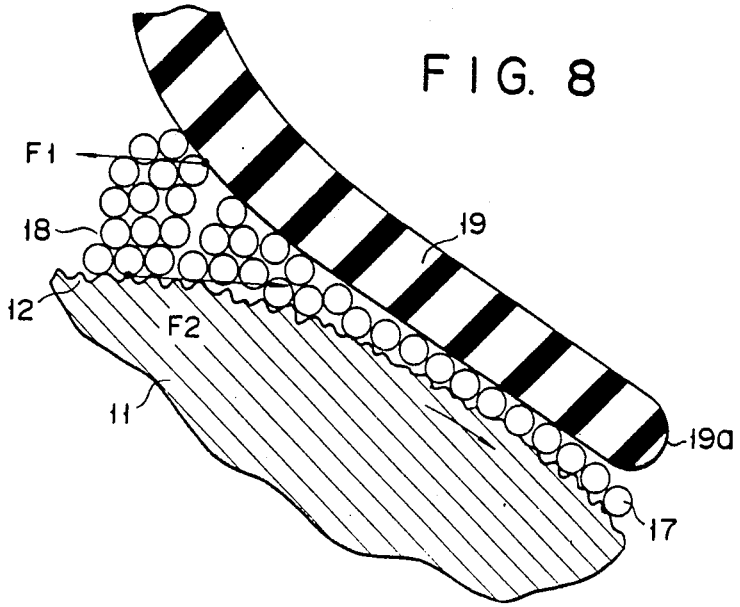
FIG. 8 is an enlarged sectional view showing the contact area between the developing roll and the elastic blade of a second embodiment.
Figure 9:
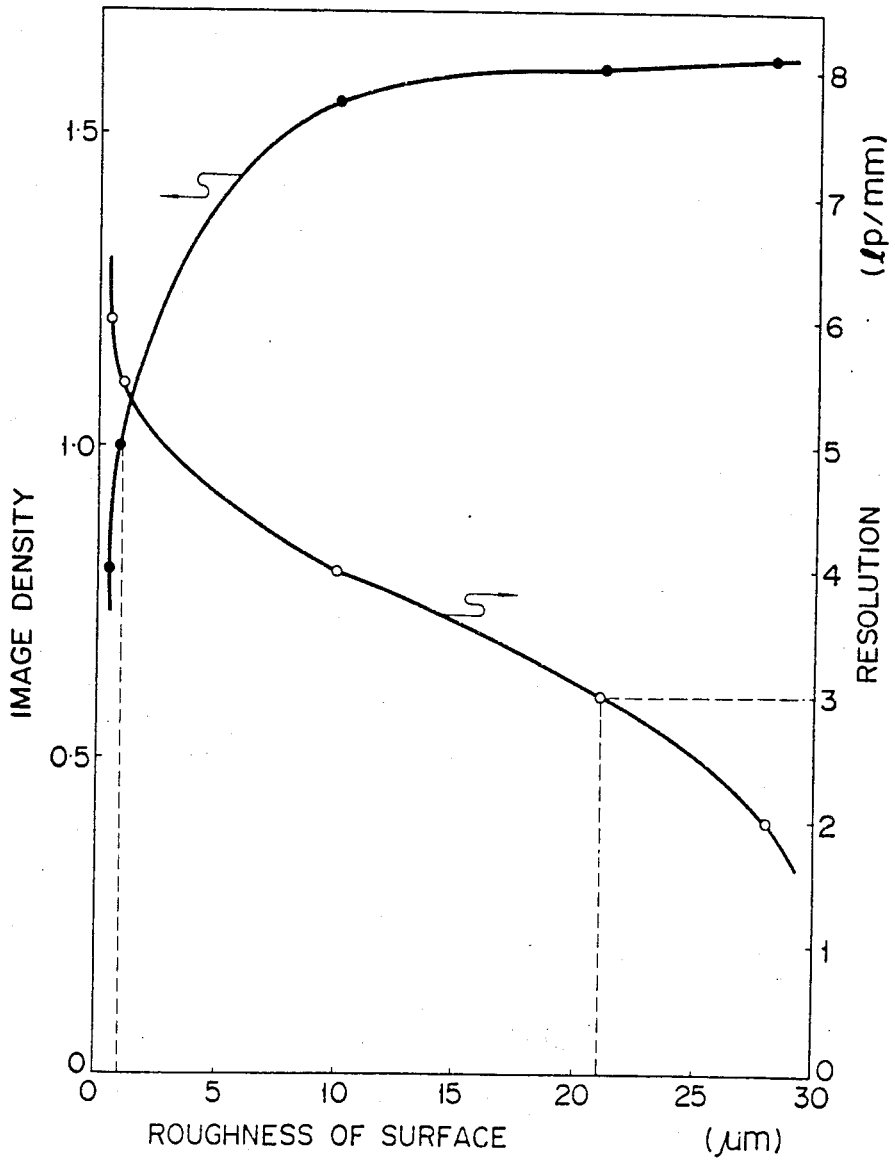
FIG. 9 is a chart showing the relationship of the roughness of the surface of the developing roll to the image density and to resolution.

In the above embodiment, a metal plate (particularly, a phosphor bronze plate) is used as a flexible coating member. However, the flexible coating member is not limited to this, but any plate having elasticity can be adopted. For example, as shown in FIG. 8 as a second embodiment, an elastic blade 19 (more particularly, a urethane rubber blade) can be used instead of the metal plate. Note that the urethane rubber blade 19 has a hardness of 30 and a thickness of 2 mm. In the developing apparatus using the urethane rubber blade 19, the surface roughness of the roughened surface of a developing roll 11 was varied, and the resultant copy density and resolution were measured. The result from this test is shown in FIG. 9. Assume that criteria of a good/bad image are an image density of 1.0 or more and a resolution of 3.0 or more. When the roughness of the surface falls within the range between 1 μm to 21 μm, a good image can be obtained. Since the average diameter of the toner particles is 14 μm, the proper surface roughness becomes 0.07 to 1.5 times the average diameter of the toner particles.

In the aforementioned method for forming toner film, a very thin toner layer of a uniform thickness can be formed on the peripheral surface of the developing roller 11 by adjusting the toner 17, the roller 11, and the elastic blade 13 so that $\mu t < \mu r$ and $\mu t < \mu b$, where $\mu t$ is the internal friction coefficient of the toner 17, and $\mu r$ and $\mu b$ are the coefficients of kinetic friction between the peripheral surface of the roller 11 and the toner 17 and between the surface of the blade 13 and the toner 17, respectively. Thus, toner particles are given a uniform and sufficient electric charge for the formation of a satisfactory developed image.

The following are the reasons why a uniform thin toner layer can be formed under the aforesaid conditions.

Figure 10:
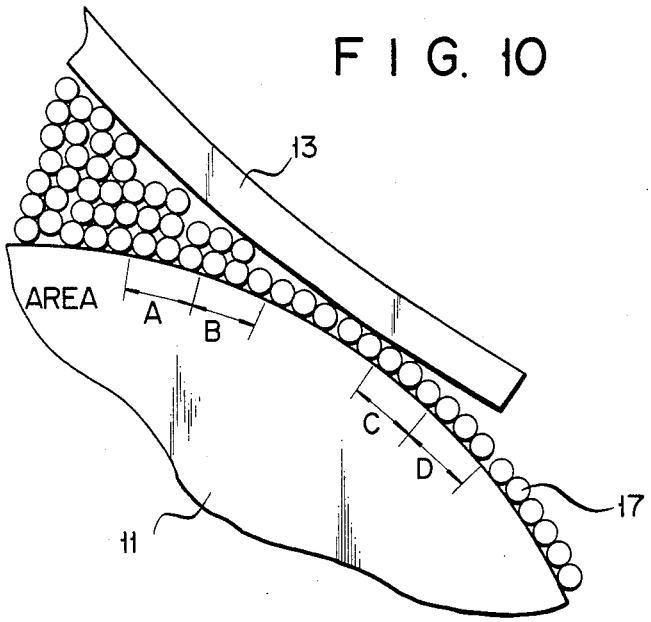
FIG. 10 is a side view schematically showing a process for forming a toner layer.
Figure 11A:
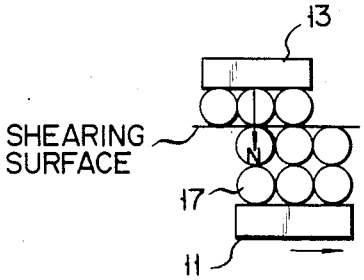
FIGS. 11A, 11B, 11C, and 11D are side views diagrammatically showing processes for thinning the toner layer in succession.
Figure 11B:
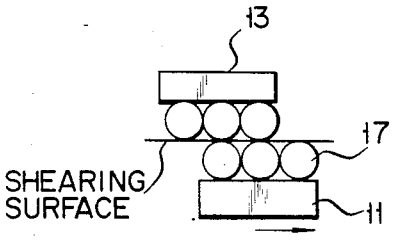
Figure 11C:
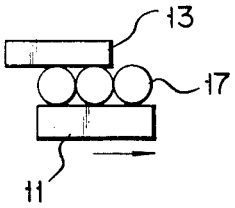
Figure 11D:
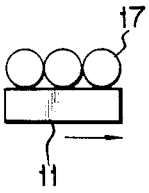

In forming a thin layer of nonmagnetic toner 17 on the peripheral surface of the developing roller 11, the steps show in FIGS. 10 and 11A to 11D are followed. FIG. 10 shows a process for thinning the toner layer, and FIGS. 11A to 11D are diagrams schematically showing the elastic blade 13 and the developing roller 11, approximated by two parallel planes, corresponding to regions A, B, C, and D of FIG. 10, respectively. It may be seen from these drawings that the toner is thinned by continuous shearing of a layer of toner powder.

Referring now to FIGS. 11A to 11D, the conditions of the shearing of the toner layer will be described. If the coefficients of friction and frictional forces between the toner, the developing roller, and the elastic blade are given as shown in Table 1, there is a relation $F = \mu N$, where N and F are pressure and frictional force, respectively, acting on the toner.

TABLE 1

| | Friction coefficient | | Frictional force | |
|---|---|---|---|---|
| | Static | Kinetic | Static | Kinetic |
| Blade-toner | $\mu b''$ | $\mu b$ | $Fb''$ | Fb |
| Toner-toner | $\mu t''$ | $\mu t$ | $Ft''$ | Ft |
| Roller-toner | $\mu r''$ | $\mu r$ | $Fr''$ | Fr |

A shearing surface or sliding surface can be produced in the toner layer with the movement of the developing roller only if there is the following relation:

$$Ft'', Ft < Fb, Fb'', Fr'', Fr \quad (1)$$

In this condition, a slide is caused between the toner particles before it is caused between the blade and the toner or between the roller and the toner, so that the toner layer is sheared. The toner layer, ultimately thinned by the repetition of the shearing, must escape from the pressure of the elastic blade while adhering to the surface of the developing roller (see FIGS. 11C and 11D). To attain this, a slide must be caused between the toner and the blade, and there must be the relation $$Fb'', Fb < Fr'', Fr \quad (2)$$

The relations (1) and (2) indicate that a thin toner layer can be formed on the surface of the roller only if there is the relation $$Ft'', Ft < Fb'', Fb < Fr'', Fr \quad (3)$$

or $$\mu l, \mu t < \mu b, \mu b, < \mu l, \mu r \quad (4)$$

Here the pressure N on the layer is constant.

Figure 12:
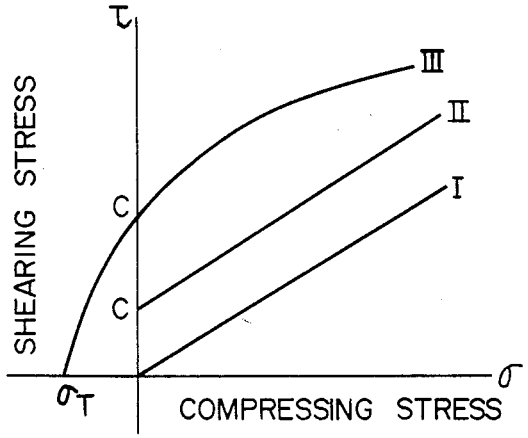
FIG. 12 is a diagram showing a basic fracture envelope of powder.

In general, stress in a layer of powder, such as the toner, is considered on the basis of a critical balance or plastic equilibrium as a dynamic behavior of the powder layer. If constant compressive stress $\sigma$ is exerted on any plane in the powder layer and if a shearing stress $\tau$ is applied along the plane, a slide is caused when $\tau$ reaches its critical value, and $\tau$ cannot take any higher value. The critical value of $\tau$ varies with various values of the compressive stress $\sigma$, and their correlation may be expressed by a single line or fracture envelope on a plane with its axes of coordinates indicative of $\sigma$ and $\tau$. If the envelope is a straight line, like lines I and II of FIG. 12, it may be under the application of the Coulomb's law related to solid friction, and the friction coefficient of the powder layer can primarily be determined according to $$\tau = \mu i \sigma + C = \sigma \tan \phi 1 + C \quad (5)$$

where $\mu i$ and $\phi i$ are the internal friction coefficient and the internal friction angle, respectively, and C indicates the adhesion or cohesion of the powder. If the powder is a nonadherent powder, 0 (zero) is substituted for C in equation (5), and the relation represented by line I of FIG. 12 is obtained. Those powders whose fracture envelopes are straight lines, like lines I and II of FIG. 12, are called Coulomb powders. Line III of FIG. 12 indicates the envelope of a non-Coulomb powder, and is expressed by $$\left(\frac{\tau}{C}\right)^n = \frac{\sigma + \sigma_T}{\sigma_T} \quad (6)$$

Figure 13:
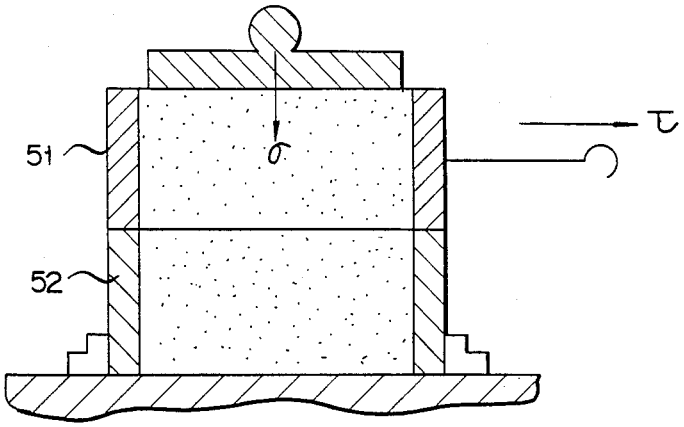
FIG. 13 is a sectional view showing a shearing device used in a direct single-plane shearing test on toners.

Here $\sigma_T$ and n are the tensile strength and the shear index, respectively, of the powder layer. If $n=1$, the powder is a Coulomb powder. Generally, $n>1$ is a condition of a non-Coulomb powder, and if n increases, then the fluidity of the powder is lowered in proportion. Shearing stress $\tau$ is then conventionally measured by the direct single-plane shearing method. The principle of this method is effected as follows. First, upper and lower cells 51 and 52 are stacked in layers and filled with powder, as shown in FIG. 13. Stationary cell 52 is fixed, and movable cell 51 is pulled horizontally under a vertical stress $\sigma$. Thus, the stress $\tau$ at which the powder layer is sheared is determined. The fracture envelope is obtained by measuring $\tau$ for varied values of $\sigma$. In this manner, the internal friction coefficient of the powder can be detected.

Figure 14:
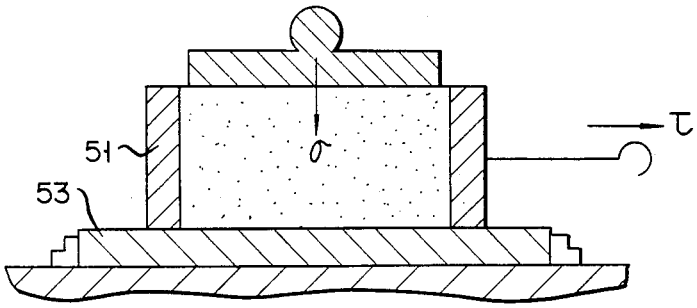
FIG. 14 is a sectional view schematically showing a measuring device for measuring the kinetic friction coefficient between the developing roller and the toner or between the elastic blade and the toner.

The internal friction coefficient of the toner layer was measured by the use of the shearing cells shown in FIG. 13. The measurement conditions were as follows. A ring, 76 mm in outside diameter, 61 mm in inside diameter, and 5 mm high, was used for each of cells 51 and 52. The height of the toner layer was 5 mm for both the upper and lower cells, and the shearing speed was 0.1 mm/sec. Under these conditions, the range of vertical loading was changed. In measuring the friction coefficients between the blade and the toner and between the roller and the toner, movable cell 51 was placed on a fixed flat plate 53 (100 mm by 100 mm) of the same material and with the same surface roughness as the elastic blade or developing roller, and the movable cell 51 was pulled in the direction of the arrow under load, as shown in FIG. 14. As for the conditions of this measurement, the toner layer height, cell moving speed, and pre-load were 5 mm, 0.1 mm/sec, and 400 g/cm$^2$, respectively, and the load was varied from 50 g/cm$^2$ to 400 g/cm$^2$.

Figure 15:
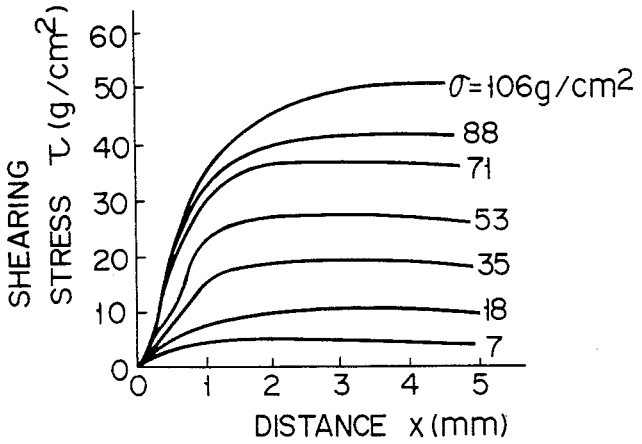
FIG. 15 is a diagram showing some data on the shearing stress of the toner layer measured by the shearing device of FIG. 13.
Figure 16:
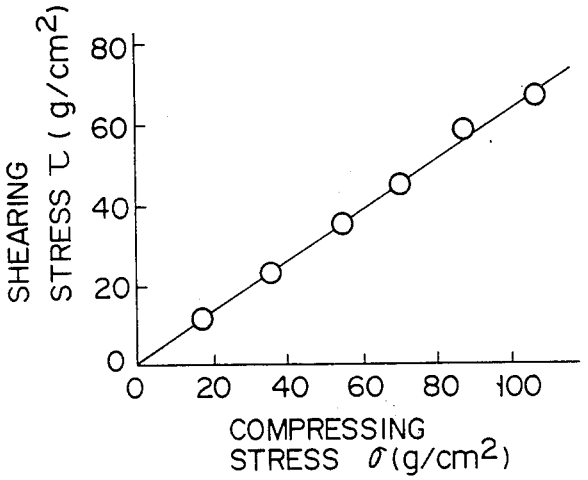
FIG. 16 is a diagram showing a fracture envelope obtained from the data of FIG. 15.

FIG. 15 shows the results of measurement of the shearing stress of the toner layer, while FIG. 16 shows the fracture envelope obtained from the results. In this case, the gradient of the envelope (i.e., the internal friction coefficient $\mu t$ of the layer) was 0.53. Five toners, different in resin composition, pigment, and particle size distribution, were measured for their internal friction coefficient $\mu t$, and the figures for toners A, B, C, D, and E were 0.42, 0.49, 0.53, 0.58, and 0.64, respectively.

Meanwhile, five different aluminum plates for the developing roller and five different phosphor bronze plates for the elastic blade, as shown in Table 2, were prepared as an equivalent of the flat plate 53 of FIG. 14.

TABLE 2

| Base/Type | a | b | c | d | e |
|---|---|---|---|---|---|
| Aluminum plate | Specular Finishing (<1 μm) | 2 μm | 3 μm | 5 μm | 7 μm |
| Phosphor Bronze Plate | Specular Finishing (<1 μm) | 2 μm | 3 μm | 5 μm | 7 μm |

The friction coefficient $\mu r$ between the roller and the toner was measured on an aluminum plate of type a of Table 2. The resultant figures for toners A, B, C, D, and E with the aforesaid internal friction coefficients were 0.48, 0.50, 0.52, 0.54, and 0.57, respectively. For an aluminum plate of type c, the figures were 0.50, 0.52, 0.54, 0.57, and 0.60.

The kinetic friction coefficient $\mu b$ between the blade and the toner was measured on a phosphor bronze plate of type a of Table 2 by means of the device of FIG. 14. The resultant figures for toners A to E were 0.48, 0.51, 0.52, 0.54, and 0.57, respectively. For a phosphor bronze plate of type c, the figures were 0.50, 0.53, 0.55, 0.57, and 0.60.

Figure 17:
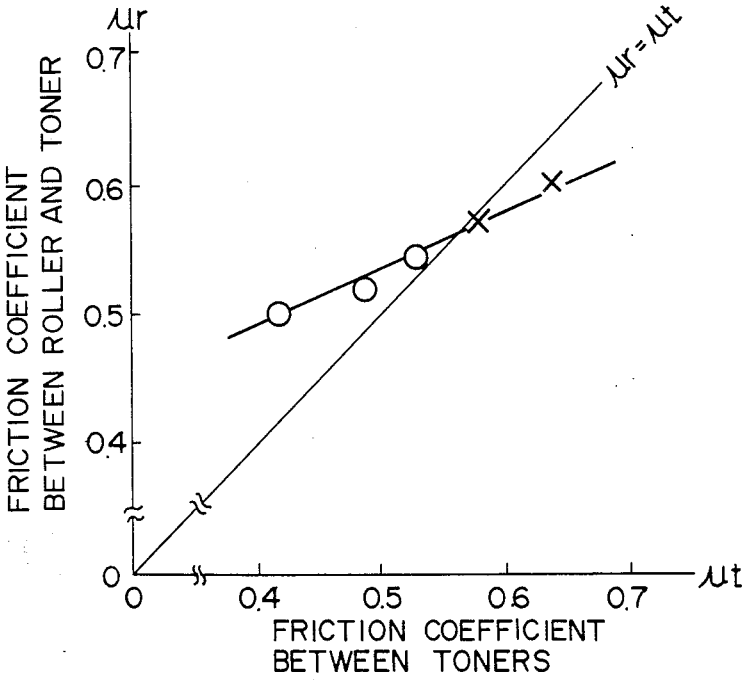
FIG. 17 is a diagram showing the relationship between the formed thin toner layer and the friction coefficient between the toner and the developing roller.
Figure 18:
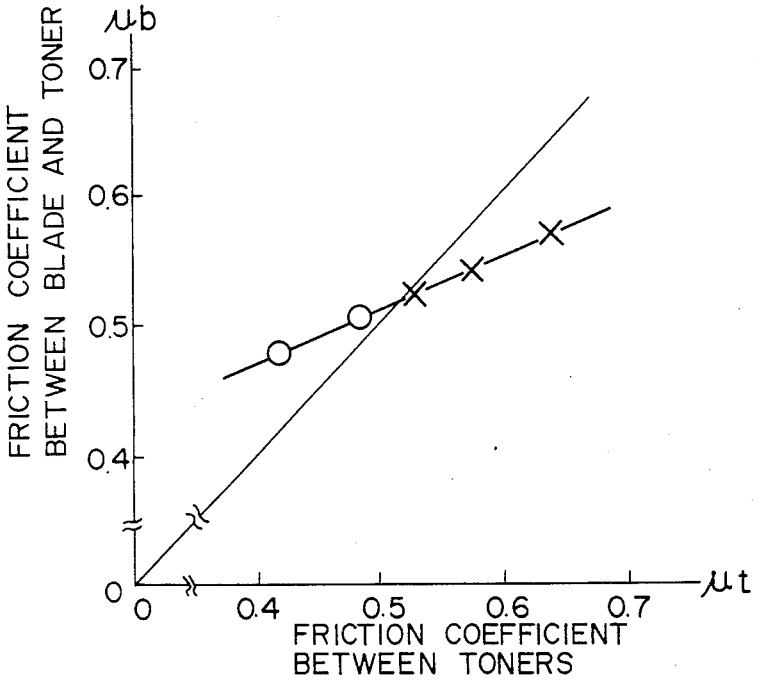
FIG. 18 is a diagram showing the relationship between the formed thin layer and the friction coefficient between the toner and the elastic blade.

The toners A to E with the aforesaid internal friction coefficients were fed into a developing device which uses the aluminum plate of type c of Table 2 (aluminum roller with surface roughness of 3 μm) for developing roller 11 shown in FIG. 4. Then, toner layers were formed on the peripheral surface of roller 11 by means of the elastic blade 13 which is equivalent to the phosphor bronze of type a of Table 2. In this situation, the quality of acceptability of the toner layers, with respect to the relationships between the internal friction coefficient $\mu r$ between the roller and the toner, and between the coefficient $\mu t$ and the kinetic friction coefficient $\mu b$ between the blade and the toner, was examined. FIGS. 17 and 18 show the results of the examination. In these drawings, each circle indicates the formation of a uniform thin toner layer with a thickness of 13 μm to 70 μm, while each cross indicates a failure in such a formation. As seen from the results shown in FIGS. 17 and 18, there must be relations $$\mu t < \mu r, \text{ and} \quad (7)$$

$$\mu t < \mu b \quad (8)$$

in order to obtain a uniform thin toner layer.

Further, the toner A with the internal friction coefficient of 0.42 was put into the movable cell 51 of the device shown in FIG. 14, and the kinetic friction coefficient was measured on aluminum and phosphor bronze plates of types a to e of Table 2. The results are as shown in Table 3.

TABLE 3

| Base/Type | a | b | c | d | e |
|---|---|---|---|---|---|
| Aluminum plate | 0.48 | 0.49 | 0.50 | 0.51 | 0.53 |
| Phosphor Bronze Plate | 0.48 | 0.49 | 0.50 | 0.51 | 0.53 |

Figure 19:
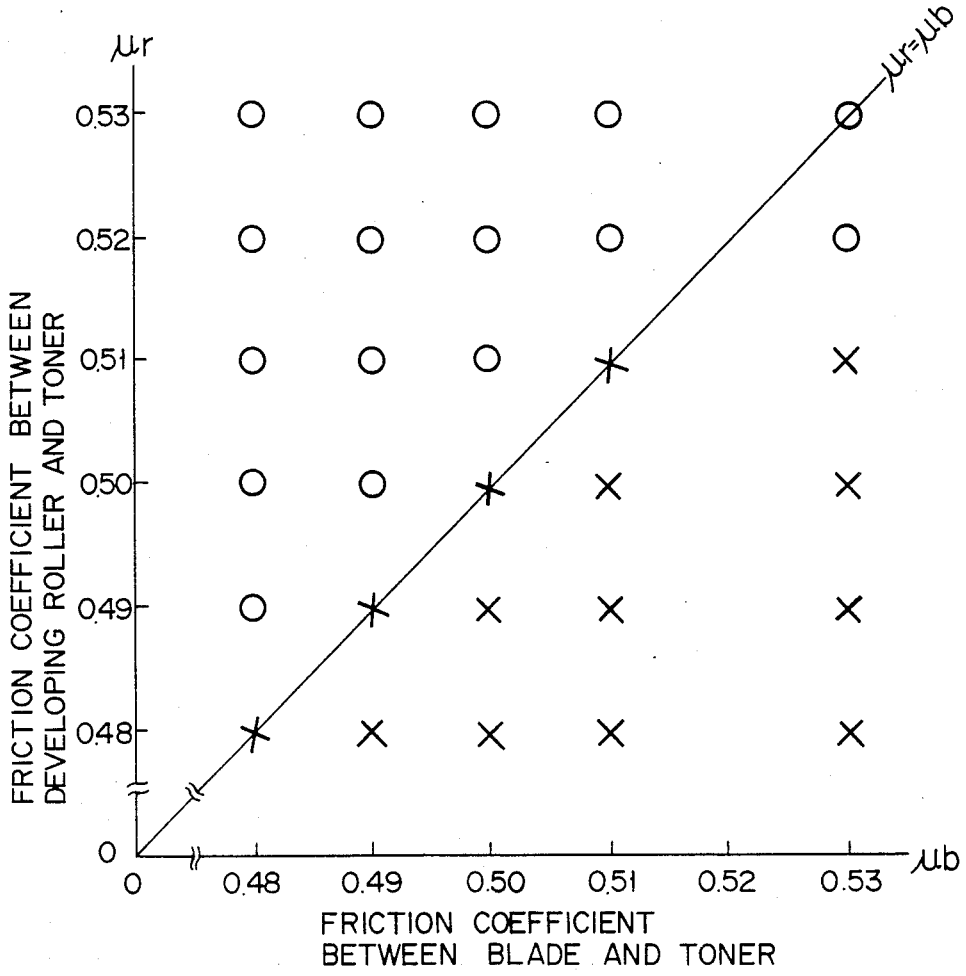
FIG. 19 is a diagram showing the relationship between the formed thin layer and the friction coefficient between the roller and the blade.

FIG. 19 shows the correlations between the values on Table 3 and the uniformity of the actually formed toner layers. The results indicate that uniform thin toner layers can securely be formed if the following relationship is maintained:

$$\mu b < \mu r. \quad (9)$$

As shown in FIG. 19, however, some spots (e.g., points given by $\mu b = 0.63$ and $\mu r = 0.57$) within a region expressed by $\mu b > \mu r$ permit the formation of satisfactory thin toner layers. These spots are distributed in those regions where $\mu r$ is relatively high. This indicates that where $\mu t < \mu r$ and if $\mu r$ is sufficiently high, uniform thin toner layers can be formed even with $\mu b > \mu r$. In order to increase the kinetic friction coefficient $\mu r$ between the roller and the toner, however, the surface of the developing roller must be roughened. Therefore, in flying the toner layer to form a developed image on the photosensitive drum, the difference in electric field strength between projections and recesses of the roller surface is great, resulting in voids or other undesired effects on the image quality.

In consideration of these circumstances and the coincidence of relation (9) and relation (2), which is derived from the models shown in FIGS. 11A to 11D, the requirement of relation (2) should preferably be met for the formation of uniform toner layers and high-quality images. From inequalities (7), (8), and (9), we obtain $$\mu t < \mu b < \mu r. \quad (10)$$

The requirement of this relation agrees with that of inequality (4) derived from the models of FIGS. 11A to 11D. Although intensity (4) includes the static friction coefficient $\mu$, the above described experimental results indicate that the main factor governing the process of toner layer formation is the kinetic friction coefficient $\mu$. This suggests that a slide or roll actually is caused between the developing roller and the toner and between the elastic blade and the toner during the process of toner layer shearing under pressure from the blade.

A thin toner layer was formed under the condition of relation (10), and a latent image was actually developed by means of the toner layer. Thereupon, a satisfactory visible image was obtained without any irregularity, fog, or lack of density. For the optimum developing conditions, we used a distance between the roller and the drum ranging from 0.1 to 0.25 mm, a maximum surface potential from 40 to 1,000 volts, a first blade pressure from 30 to 180 g/cm, an AC developing bias from 800 to 2,300 volts (peak value difference), a frequency from 600 to 1,500 hertz, and a DC developing bias from 100 to 500 volts.

As described above, according to the present invention, a developing apparatus which can uniformly form a high quality image having a sufficient copy density by using a one-component developing agent consisting of nonmagnetic toner can be obtained, and a compact, light-weight, low-price image forming apparatus such as a copying machine which adopts this developing apparatus can be effectively provided.

What is claimed as new and desired to be secured by Letters Patent of the United States:

1. A developing apparatus for developing a latent image formed on an image carrier by a non-magnetic developing agent consisting essentially of non-magnetic particles, said developing apparatus comprising:

(a) an image carrier;

(b) a developing agent carrier for carrying the non-magnetic developing agent thereon in the form of a layer, said developing agent carrier being disposed apart from said image carrier by a prescribed distance; and (c) an elastic metal member formed of a metallic material and pressed against one surface of said developing agent carrier to apply the non-magnetic developing agent thereto, so that the non-magnetic developing agent is applied to the surface of said developing agent carrier by said elastic metal member to form a thin layer of the non-magnetic developing agent on the surface of said developing agent carrier;

(d) the thin layer of the non-magnetic developing agent being opposed to said image carrier to deposit the non-magnetic developing agent on the latent image of said image carrier, thereby developing the latent image;

(e) the thickness of the thin layer of the non-magnetic developing agent being smaller than the prescribed distance;

(f) said developing agent carrier having a surface which is opposed to said image carrier and the whole of which is roughened;

(g) said dveloping agent carrier being electricaly connected to said elastic metal member;

(h) the relation among $\mu t$, $\mu b$, and $\mu r$ being:

$$\mu t < \mu b < \mu r$$

where the value $\mu r$ is the friction coefficient between said developing agent carrier and the non-magnetic developing agent, the value $\mu t$ is the friction coefficient between the particles of the developing agent, and the value $\mu b$ is the friction coefficient between said elastic metal member and the non-magnetic developing agent.

2. The developing apparatus according to claim 1, wherein said elastic metal member is a thin metal blade.

3. The developing apparatus according to claim 2, wherein said thin metal blade is made of phosphor bronze.

4. The developing apparatus according to claim 3, wherein the surface roughness of said developing agent carrier is 0.07 to 1.0 times the average diameter of the particles of the non-magnetic developing agent.

5. The developing apparatus according to claim 4, wherein said thin metal blade is pressed against said developing agent carrier at a pressing force of 10 g/cm to 2,500 g/cm.

6. The developing apparatus according to claim 4, wherein said thin metal blade has a thickness of 0.1 to 0.4 mm.

7. The developing apparatus according to claim 1, wherein said developing agent carrier has a hard layer which is formed on the roughened surface thereof by a hard-plating treatment.

8. The developing apparatus according to claim 1 wherein said developing agent carrier is electrically connected to said elastic metal member by a power source which applies a bias voltage to said developing agent carrier.

9. The developing apparatus according to claim 1, wherein at least one end face of said elastic metal member positioned adjacent to the working surface of said developing agent carrier has a moderately curved surface formed by polishing.

10. The developing apparatus according to claim 1, wherein the working surface of said elastic metal member except for the free end portion thereof is brought into surface contact with the working surface of said developing agent carrier.

11. Apparatus for developing a latent image formed on an image carrier using a non-magnetic developing agent consisting essentially of non-magnetic particles, said apparatus comprising:

(a) an image carrier;

(b) a developing roll which is rotatable about a central axis and which has a roughened circumferential working surface, the roughened circumferential working surface of said developing roll and said image carrier being spaced apart by a prescribed distance;

(c) an elastic member having a smooth working surface pressed tangentially against the roughened circumferential working surface of said developing roll by a prescribed force, the smooth working surface of said elastic member and the roughened circumferential working surface of said developing roll defining a metering nip for a non-magnetic developing agent sized, shaped, and positioned to allow a thin layer of the non-magnetic developing agent to pass therethrough to coat the roughened circumferential working surface of said developing roll, the thickness of the thin layer of the non-magnetic developing agent being less than the prescribed distance between the roughened circumferential working surface of said developing roll and said image carrier;

(d) means for feeding the non-magnetic developing agent to said metering nip; and (e) means for applying a bias voltage both to said developing roll and to said elastic member, thereby preventing the smooth working surface of said elastic member from being charged by friction, (f) wherein the roughness of the roughened circumferential working surface of said developing roll and the roughness of the smooth working surface of said elastic member are such that:

$$\mu t < \mu b < \mu r$$

wherein $\mu r$ is the coefficient of friction between the roughened circumferential working surface of said developing roll and the particles of the non-magnetic developing agent, $\mu t$ is the coefficient of friction between the particles of the non-magnetic developing agent, and $\mu b$ is the coefficient of friction between the particles of the non-magnetic developing agent and the smooth working surface of said elastic member.

12. Apparatus as recited in claim 11 wherein said elastic member is made of metal.

13. Apparatus as recited in claim 11 wherein said elastic member is made of phosphor bronze.

* * * * *

UNITED STATES PATENT AND TRADEMARK OFFICE

CERTIFICATE OF CORRECTION

PATENT NO. : 4,656,965

DATED : April 14, 1987

INVENTOR(S) : Masahiro Hosoya, et al

It is certified that error appears in the above-identified patent and that said Letters Patent is hereby corrected as shown below:

Related U.S. Application Data worded incorrectly on Letters Patent, Line [63].
Should read as follows:

-- Continuation-in-part of Ser. No. 831,092, Feb. 21, 1986, which is a continuation of Ser. No. 785,038, Oct. 8, 1985, abandoned, which is a continuation-in-part of Ser. No. 655,444, Sep. 28, 1984, abandoned. --

Signed and Sealed this

Tenth Day of November, 1987

*Attest:*

DONALD J. QUIGG

*Attesting Officer*

*Commissioner of Patents and Trademarks*